United States Patent [19]

Ignell

[11] 4,243,152

[45] Jan. 6, 1981

[54] TEAR-UP CLOSING DEVICE FOR CONTAINERS

[75] Inventor: Rolf L. Ignell, Divonne-les-Bains, France

[73] Assignee: Tetra Pak Developpement SA, Lausanne, Switzerland

[21] Appl. No.: 762,137

[22] Filed: Jan. 24, 1977

[30] Foreign Application Priority Data

Jan. 30, 1976 [SE] Sweden ..... 7600989

[51] Int. Cl.[3] ..... B65D 17/34; B65D 39/00

[52] U.S. Cl. ..... 220/270; 220/307

[58] Field of Search ..... 220/265, 266, 254, 270, 220/306, 307

[56] References Cited

U.S. PATENT DOCUMENTS

| | | | |
|---|---|---|---|
| 3,021,976 | 2/1962 | Tracy | 220/307 X |
| 3,282,477 | 11/1966 | Henchert | 220/270 X |
| 3,833,144 | 9/1974 | Bollmann | 220/270 X |
| 3,990,603 | 11/1976 | Brochman | 220/270 X |
| 3,999,678 | 12/1976 | Ignell et al. | 220/307 X |

*Primary Examiner*—Steven M. Pollard

*Attorney, Agent, or Firm*—Burns, Doane, Swecker & Mathis

[57] ABSTRACT

An improved tear-up closing device for a container intended for containing a pressurized liquid (e.g., beer), and intended to form a seal over the opening of the container. The novel closing device comprises two parts, viz., (1) an outer part consisting essentially of a tubular body functioning as a gas-tight closure of the opening of the container, and (2) an inner part which defines a pouring opening of the container, this latter consisting essentially of a sealing body. Said outer and inner parts are joined together along a thin, relatively easily breakable wall.

7 Claims, 6 Drawing Figures

TEAR-UP CLOSING DEVICE FOR CONTAINERS

Figure 1:
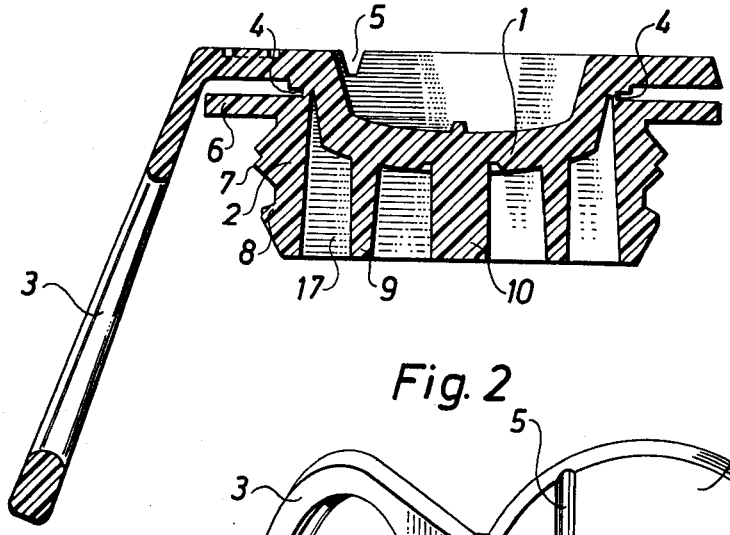

The present invention relates to a tear-up closing device for containers, intended in particular for pressurized contents, such as beer or aerated beverages, which closing device is adapted to form a seal in the opening of the said containers.

It is known that beer, refreshing beverages and similar pressure-generating contents can be packed in relatively thin plastic containers which are provided with an opening part comprising a lip edge directed inwards. The closing arrangement for these known containers consists of a closing device that can be pressed into the opening part of the container and is made to form a seal with the edge lip of the container directed inwards, which lip also retains the closing device in the opening part of the container in that an edge bulge of the closing part is made to snap over the front edge of the lip directed inwards. With the help of the natural tension and springiness of the edge lip directed inwards a sufficient sealing pressure between the said lip and the pressed-in part of the closing device can be obtained so as to prevent any leakage from the packing container of the pressurized gas, in particular carbon dioxide, emanating from the contents.

Even though the closing part can be adapted in such a manner that it has good gas impermeability characteristics along the contact surface between the closing device and the opening part of the container, some losses of gas are nevertheless experienced because gas diffuses out through the closing device, which for practical reasons is preferably made of polyethylene, which is a relatively soft flexible plastic material, readily obtainable by injection moulding.

It has been tried to varnish the closing part with a varnish of gastight material, e.g. polyvinylidene chloride, but whilst it was possible to achieve certain improvements, the results have not been wholly satisfactory. The technical problem of the passage of gas through the closing part can however be solved in a satisfactory manner in accordance with the present invention which is characterized in that the said closing arrangement comprises two parts, namely an outer and an inner part, the outer part of which consists of a tubular body whose outside comprises elements for the achievement of a gastight and mechanically stable fixing of the closing device in the opening part of the container and whose inside defines the pouring opening of the closing device, and that the inner part consists of a body that can be introduced into the outer part and completely covers the opening of the same, and which with parts of the body extends at least as far as the lower edge of the plane defining the tubular body of the outer part, that the said outer and inner parts are joined to one another along a thin, relatively easily breakable connecting wall which extends along the whole circumference of the upper edge of the outer part, and that a gastight disc is sealed to the lower edge of the outer part as well as onto the parts of the inner part extending into the outer part, which sealing disc is constituted of a gastight but relatively easily tearable material.

Figure 2:
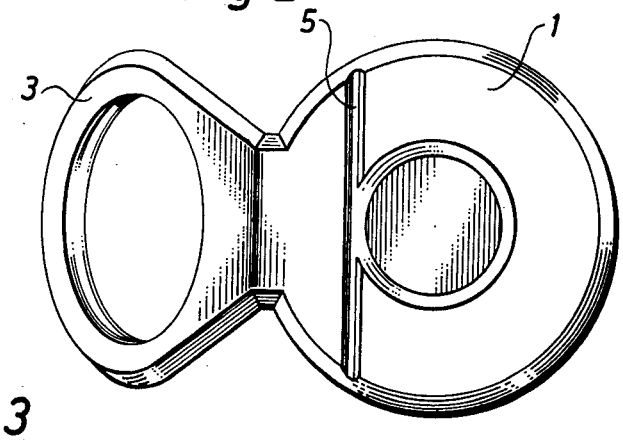
Figure 3:
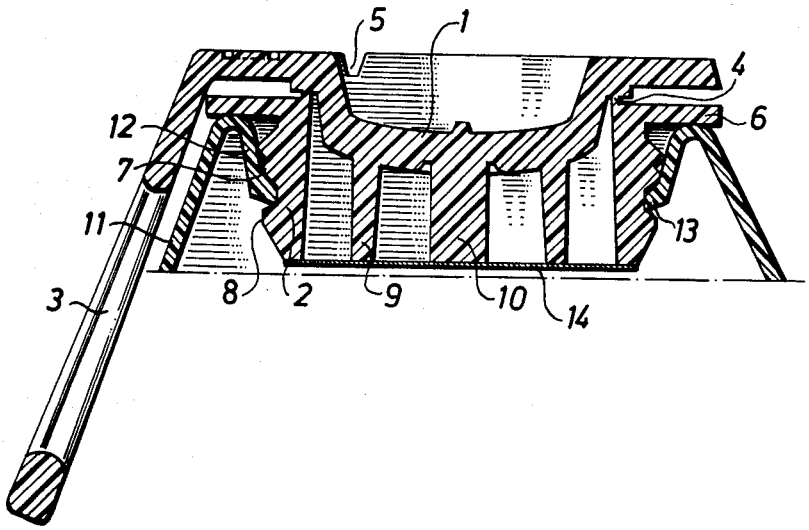
Figure 4:
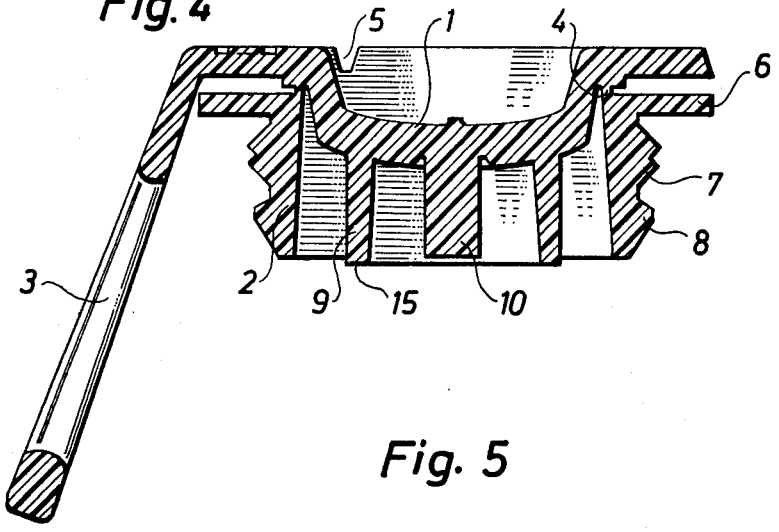
Figure 5:
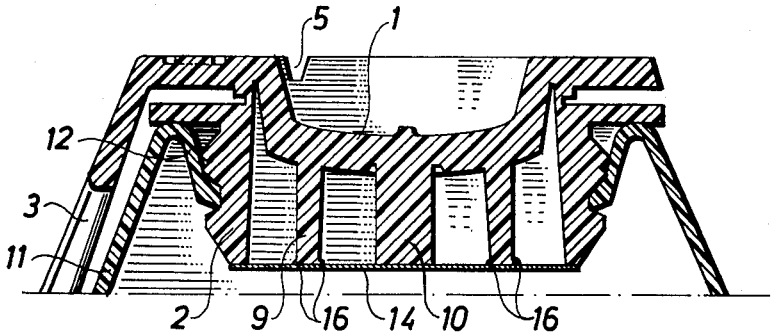
Figure 6:
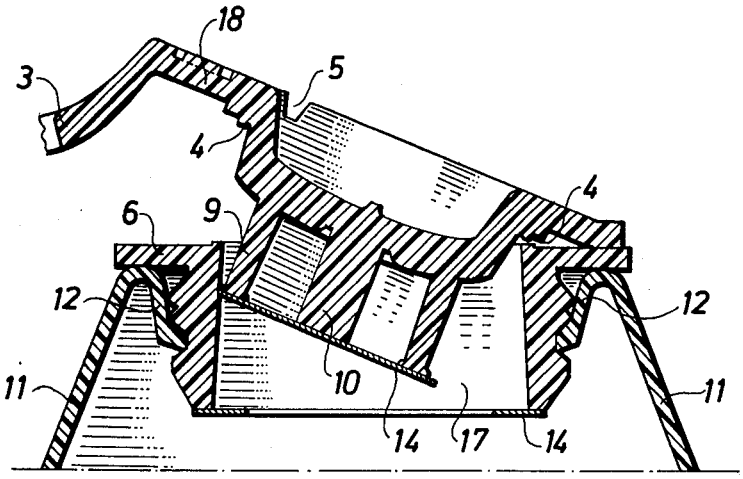

In the following will be described a special but preferred embodiment of the invention with reference to the enclosed drawing wherein FIG. 1 shows a cross-section of the injection-moulded plastic body for a closing device in accordance with the invention, FIG. 2 shows the closing device in accordance with FIG. 1 seen from above, FIG. 3 shows a cross-section of the closing device pressed into the opening of the container, FIG. 4 shows a modified injection-moulded body in accordance with FIG. 1, FIG. 5 shows a closing device made of the injection-moulded plastic body according to FIG. 4, and finally FIG. 6 shows how the closing device is opened when the packed contents are to be made accessible.

The injection-moulded plastic body shown in FIG. 1 is suitably manufactured from polyethylene, and the body consists substantially of two parts, namely an outer part 2 and an inner part 1, which are joined together by a thin easily tearable wall portion which extends along the upper edge of the outer body 2.

The outer body 2 has an upper flange 6 and a lower appreciably shorter snap edge 8 which together with the flange 6 forms the fixing element of the closing device in the pouring opening of the packing container in the manner as will be described in the following. The outer part 2 also has sealing elements 7, which in the case described here consist of sealing tongues extending around the outer part 2, which owing to the softness of the plastic material are deformable when they are pressed against a harder surface. The inner part 1, which closes the opening 17 defined by the inside of the outer part 2 so as to form a seal, has on the one hand a pull-ring 3 and on the other hand elements 9,10 projecting into the outer part. The elements 9,10 consist of a relatively thin-walled cylinder and a central column respectively which constitute integral parts of the inner part 1. The said parts 9,10 extend with their front edges as far as the lower limiting plane of the inner part 2. As can be seen from FIG. 2, the inner part 1 of the closing device is also provided with a notch 5 which is intended to facilitate the tearing up of the inner part in that parts of the wall portion 4 are being ripped up, and with the help of the notch 5 the tearing force can be concentrated on the parts of the wall portion 4 which are situated between the notch 5 and the pull-ring 3.

In FIG. 3 is shown how the closing device is fitted into the opening of a packing container 11, which packing container is assumed to be made of relatively thin plastic material and which packing container in its opening part has a lip 12 directed inwards.

As can be seen from FIG. 3, the closing device is provided with a film disc 14 of an impervious material, e.g. a plastic-coated aluminium foil, which by means of its plastic coating is fixed to the lower edge of the outer part 2 as well as the lower free surfaces of the parts 9,10 belonging to the inner part 1. The film disc 14 must have only a relatively thin thermoplastic layer, preferably a polyethylene layer so as to be easily tearable, and it has been found appropriate for the thickness to correspond to a surface coating weight of between 5 and 20 $g/m^2$ of polyethylene, preferably 10 $g/m^2$. The film disc 14 is fixed to the contact surfaces of the outer part 2 and the projecting parts 9,10 of the inner part with the help of heat and pressure, the plastic coating of the film disc being made to fuse together with the plastic material of parts of the injection-moulded plastic body 1,2 pressed against it.

As is evident from FIG. 3, the lip 12 of the packing container 11 directed inwards is gripped between the flange 6 of the outer part 2 and its snap edge 8, and this is brought about in that the closing device is pressed into the opening of the packing container 11, when the front edge 13 of the lip 12 directed inwards is made to snap over the snap edge 8 of the closing part and is fixed in the position shown in FIG. 3 with the top edge of the lip directed inwards pressed against the underside of the flange 6, whereby the closing device is retained in the pouring opening of the container at the same time as the sealing tongues 7 will be pressed against the outside of the lip 12 directed inwards, so as to form a seal. It has been found that a sealing of the abovementioned type gives very good gas impermeability characteristics, and that the discharge of gas is practically negligible even if the contents in the packing container consist of pressurized contents such as beer or refreshing beverages which inside the packing container form a pressurized gas cushion of carbon dioxide.

The said film disc 14, which comprises an aluminum foil, is likewise gastight, which means that any gas leakage through the polyethylenematerial, which in itself has less good gas impermeability characteristics, is prevented. There is of course an unprotected edge of the closing device along the outside of the snap edge 8, but it has been found that this edge has such a small surface that the gas which diffuses along this route can practically be neglected.

In a manner which will be described later the packing container is opened in that the inner part is detached from the outer part 2 and that the inner part with the help of the pull-loop 3 is forced out of the container opening which is defined by the inside of the outer part 2. To facilitate this forcing out of the inner part, the cylindrical portion 9 joined to the inner part must be made relatively thin, since otherwise it would be too rigid for being forced out of the opening 17. However, if the cylindrical part 9 is made too thin, the sealing surface along its outer free edge becomes so small there is a danger that the film disc 14 is not ripped up, but that instead the sealing joint between the cylindrical part 9 and the film disc is broken. For this reason the closing device can be modified in the manner as shown in FIG. 4, which in principle corresponds to the closing device according to FIG. 1, with the difference that the cylindrical part 9 joined to the inner part 1 is slightly lengthened so that its front edge 15 extends past the lower area of limitation of the outer part 2.

When the film disc 14 is fixed to the closing device in accordance with FIG. 4 with the help of heat and pressure, the projecting portion 15 of the cylindrical part 9 is deformed so that an enlargement of the surface is produced at the area of contact between the foil disc 14 and the lower part of the cylindrical part 9. This enlargement of the area of contact arises because the projecting portions of the cylindrical part 9 are upset so as to form bulgelike border zones 16 when the outer portions of the cylindrical part 9 are pressed back under the influence of heat against the lower area of limitation of the outer part 2, the film disc 14 being attached substantially in a single plane.

When the packing container is to be opened to make the contents accessible, the pull-ring 3 is gripped by hand and is forced upwards whereby the portion 18 of the inner part 1 is folded forward along the folding notch 5 and parts of the connecting wall 4 between the outer part 2 and the inner part 1 are broken. When the inner part 1 of the closing device is pulled further upwards in the manner as shown in FIG. 6, the whole connecting wall 4 between the inner part 1 and the outer part 2 will be torn up, and likewise the film disc 14 will be broken between the attachment to the outer part 2 and the cylindrical part 9 of the inner part 1.

After the connecting wall 4 as well as the film disc 14 have been broken, the inner part 1 can be withdrawn from the outer part 2 which will remain in the opening part of the packing container, since the lip 12 of the packing container 11 directed inwards will be retained between the snap edge 8 and the flange 6. When the inner part 1 of the closing device has been removed from the pouring opening 17 the contents can be freely poured from the packing container.

In the description given here the appearance and design of the packing container itself has not been dealt with in detail, since this design may be chosen arbitrarily and does not affect the function of the closing part. In the example given it has been assumed that the opening part of the container 11 should have a lip 12 directed inwards, which has proved to be a practical design solution which gives good gas impermeability characteristics, but it is also conceivable within the scope of the invention, that the problem could be solved by the attachment of the closing device in a different manner, e.g. by glueing or welding to the opening part of the container.

It has been found that the closing device in accordance with the invention has very low gas leakage and that a substantial improvement can be achieved compared with earlier known designs which in turn means that the time of storage for beer and refreshing beverages in packing containers of the type referred to here can be appreciably lengthened.

I claim:

1. A closure device for a container for pressurized contents said device being composed of a flexible plastic material and said container having an upper portion provided with an opening therein, said device comprising an outer tubular element with means on the outside thereof for engaging the inner wall of the opening in the container to form a gas tight and mechanically stable seal therewith and to provide a pouring opening for the container, said outer tubular element further having a bottom end surface which is spaced axially inward from said inner wall of the opening in the container, an inner element provided with a pull tab and extending downwardly within said outer tubular element, said outer tubular element and said inner element being connected to each other by a severable connecting wall around the upper inner circumference of said outer tubular element to close the pouring opening, said inner element including a depending peripheral wall portion spaced from said outer tubular element and a depending central portion disposed within and spaced from the depending peripheral wall portion, the bottom end surfaces of said outer tubular element and the peripheral wall and central portions of said inner element lying in substantially the same plane, and a substantially gas impermeable and tearable disc member sealed to the bottom end surfaces of said outer tubular element and the peripheral wall and central portions of said inner element, said depending peripheral wall portion being further constructed and arranged to be readily removable from said outer tubular element and to retain said disc member in sealing contact therewith when said inner element and outer tubular element are separated, whereby when the tab is pulled up said inner element is removed from said outer tubular element by severing the connecting wall and said tearable disc member to open the pouring opening.

2. A closure device as claimed in claim 1 wherein the depending peripheral wall portion is annular.

3. A closure device as claimed in claim 1 wherein said device is composed of polyethylene.

4. A closure device as claimed in claim 1 wherein the central portion of said inner element is cylindrical.

5. A closure device as claimed in claim 1 wherein said tearable disc member is composed of a metal foil coated with a plastic material.

6. A closure device as claimed in claim 5 wherein the plastic coating is polyethylene and has a thickness corresponding to a surface coating of 5–20 grams/$m^2$.

7. A closure device as claimed in claim 1 wherein the bottom end surface of the depending peripheral wall portion of an inner element is provided with a foot-like portion having a greater area than the cross-sectional area of the depending wall portion.

* * * * *